US009028099B2

(12) United States Patent
Spaccasassi et al.

(10) Patent No.: US 9,028,099 B2
(45) Date of Patent: May 12, 2015

(54) LED LIGHT EMITTING GROUP

(75) Inventors: Claudio Spaccasassi, Orbassano (IT); Carlo Albano, Turin (IT)

(73) Assignee: Koninklijkle Philips N.V., Eindhoven (NL)

( * ) Notice: Subject to any disclaimer, the term of this patent is extended or adjusted under 35 U.S.C. 154(b) by 90 days.

(21) Appl. No.: 13/379,058

(22) PCT Filed: Jun. 15, 2010

(86) PCT No.: PCT/IB2010/052672

§ 371 (c)(1),
(2), (4) Date: Mar. 8, 2012

(87) PCT Pub. No.: WO2010/146534

PCT Pub. Date: Dec. 23, 2010

(65) Prior Publication Data

US 2012/0155088 A1 Jun. 21, 2012

(30) Foreign Application Priority Data

Jun. 19, 2009 (IT) ..... TO2009A0466

(51) Int. Cl.

| | |
|---|---|
| ***F21S 4/00*** | (2006.01) |
| ***F21V 21/00*** | (2006.01) |
| ***F21V 14/02*** | (2006.01) |
| ***F21V 19/02*** | (2006.01) |
| *F21Y 101/02* | (2006.01) |
| *F21K 99/00* | (2010.01) |
| *F21Y 105/00* | (2006.01) |
| *F21S 2/00* | (2006.01) |

(52) U.S. Cl.

CPC ..... *F21V 19/02* (2013.01); *F21Y 2101/02* (2013.01); *F21K 9/00* (2013.01); *F21Y 2105/001* (2013.01); *F21S 2/005* (2013.01); *F21V 14/02* (2013.01)

(58) Field of Classification Search

USPC ..... 362/227, 249.01–249.11, 249.14, 239, 362/285–287, 382, 418, 419, 420, 523, 525, 362/526

See application file for complete search history.

(56) References Cited

U.S. PATENT DOCUMENTS

| | | | | |
|---|---|---|---|---|
| 6,357,893 | B1 | 3/2002 | Belliveau | |
| 6,709,132 | B2 * | 3/2004 | Ishibashi | 362/235 |
| 6,908,214 | B2 * | 6/2005 | Luk | 362/249.02 |
| 7,066,626 | B2 * | 6/2006 | Omata | 362/257 |
| 7,086,756 | B2 * | 8/2006 | Maxik | 362/249.04 |
| 2003/0156430 | A1 | 8/2003 | Ota et al. | |
| 2008/0180936 | A1 | 7/2008 | Ogashiwa | |

(Continued)

FOREIGN PATENT DOCUMENTS

| | | | |
|---|---|---|---|
| CN | 101368702 | A | 9/2008 |
| DE | 20204219 | U1 | 4/2003 |

(Continued)

*Primary Examiner* — Jong-Suk (James) Lee
*Assistant Examiner* — Alexander Garlen
(74) *Attorney, Agent, or Firm* — Meenakshy Chakravorty

(57) ABSTRACT

A LED light emitting group (1) apt to produce an outgoing light beam having its own optical axis (8) is equipped with a plurality of LEDs (18), distributed on a plate-shaped body (13) and having a fixed central plane portion (14) orthogonal to the optical axis (8) and a crown (13) of peripheral plane portions (16) tilted with respect to the central plane portion (14) and converging the one towards the other one and towards the central plane portion (14) and the optical axis (8); each one of said plane portions (14, 16) carrying a plurality of said LEDs (18).

12 Claims, 5 Drawing Sheets

(56) References Cited

U.S. PATENT DOCUMENTS

| | | | | |
|---|---|---|---|---|
| 2008/0212329 | A1* | 9/2008 | Duguay et al. | 362/310 |
| 2008/0238323 | A1 | 10/2008 | Chan et al. | |
| 2008/0247163 | A1* | 10/2008 | Chen | 362/237 |
| 2009/0201681 | A1* | 8/2009 | Galke et al. | 362/249.07 |
| 2009/0303718 | A1* | 12/2009 | Zheng et al. | 362/249.02 |
| 2010/0135017 | A1* | 6/2010 | Wulfinghoff | 362/235 |

FOREIGN PATENT DOCUMENTS

| | | | |
|---|---|---|---|
| DE | 102007046639 | A1 | 4/2009 |
| EP | 1411290 | A1 | 4/2004 |
| EP | 1722156 | A1 | 11/2006 |

* cited by examiner

LED LIGHT EMITTING GROUP

FIELD OF THE INVENTION

The present invention relates to a LED light emitting group.

BACKGROUND OF THE INVENTION

In the field of lighting in general it is known utilizing different typologies of light emitting groups, which differ the ones from the other ones above all in the type of the used light sources. More in detail, as light source, it is known using halogen lamps, filament lamps or lamps with metallic iodides fed with low voltage (usually between fifty and three hundred eighty volts) or light emitting diodes, commonly known as LEDs and fed with very low voltage.

However, the known light sources, in turn, even if they solve different problems characteristic of the above-mentioned lamps, suffer from the drawback of emitting light beams, the light intensity thereof is much lower than that of the emitting groups fed with low voltage, and for this reason they do not allow obtaining the same lighting effect.

The known emitting groups using LED sources, then, particularly complex from an implementing point of view and with high costs above all due to the fact that they include complex focusing optical systems necessary to focus the beams emitted by the single LED sources in the provided focusing point. Still for the preceding reasons, the groups with LED sources result to be also relatively bulky.

At last, the implementing features of the known emitting groups with LED sources do not allow varying the geometrical features of the light beam outgoing from the emitting group itself and, for this reason, each lighter is created to be aimed at a specific use without the adapting possibility.

The object of the present invention is to implement a LED light emitting group, allowing to solve in a simple way the problems illustrated above and, in particular, resulting to be implemented in a simple and inexpensive way and with a high and constant efficiency and functional reliability.

An additional object of the present invention, then, is to implement an emitting group which can be adapted or adjusted, that is able to allow, in a simple way, an arbitrary configuration of the emitted light beam.

SUMMARY OF THE INVENTION

According to the present invention a LED light emitting group is implemented, comprising a plurality of LEDs apt to generate an outgoing light beam having its own optical axis and means for supporting said LEDs, characterized in that said supporting means comprises a coupling base and a plate-shaped body carried by said coupling base and comprising a central plane portion orthogonal to said optical axis and a crown of peripheral plane portions tilted with respect to said central plane portion and converging the one towards the other one and towards the central plane portion and said optical axis; each one of said plane portions carrying a plurality of said LEDs.

Preferably, in the above defined group, said plate body is implemented as a single piece.

BRIEF DESCRIPTIONS OF THE DRAWINGS

The invention will be now described with reference to the enclosed figures, which illustrate some implementing, but not limiting examples thereof, wherein.

Figure 1:
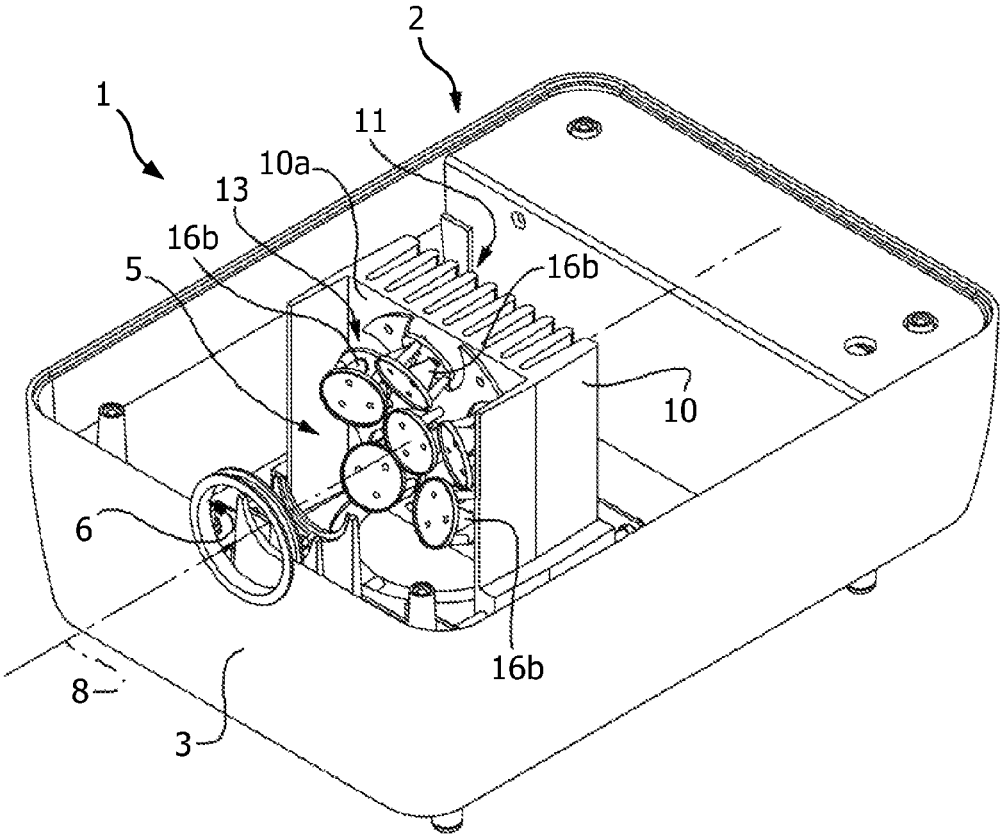
FIG. 1 is a perspective view, with removed portions for clarity, of a preferred embodiment of the LED emitting group according to the present invention.
Figure 4:
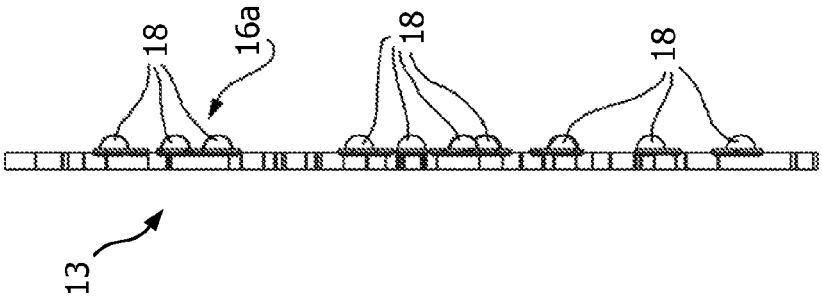
FIGS. 3 and 4 illustrate in a plan and side view, respectively, a detail of FIGS. 1 and 2 in a not deformed condition thereof.
Figure 3:
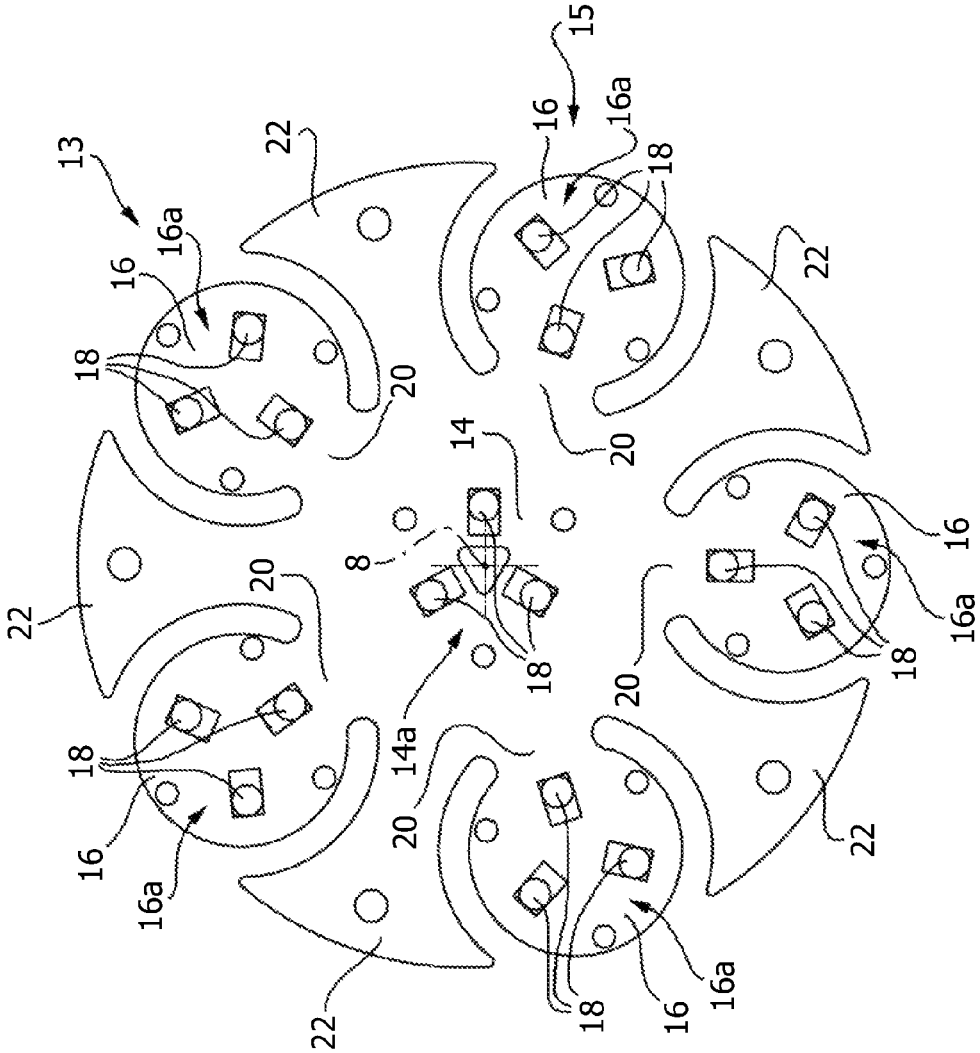
Figure 5:
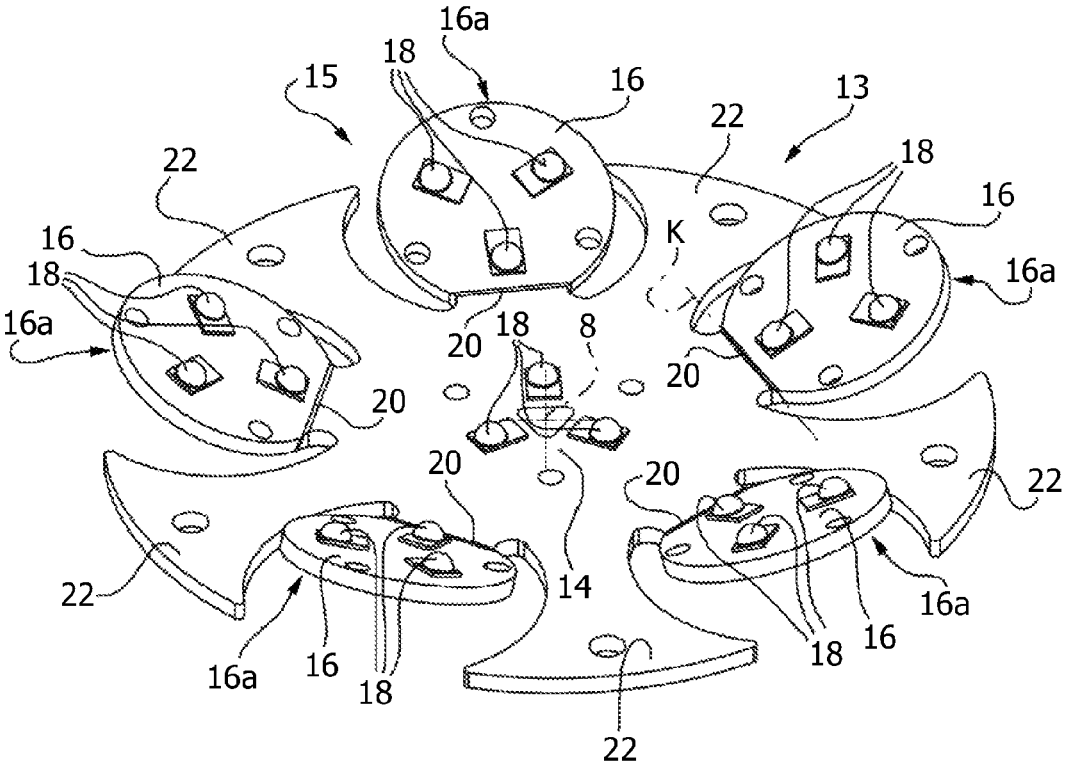
Figure 6:
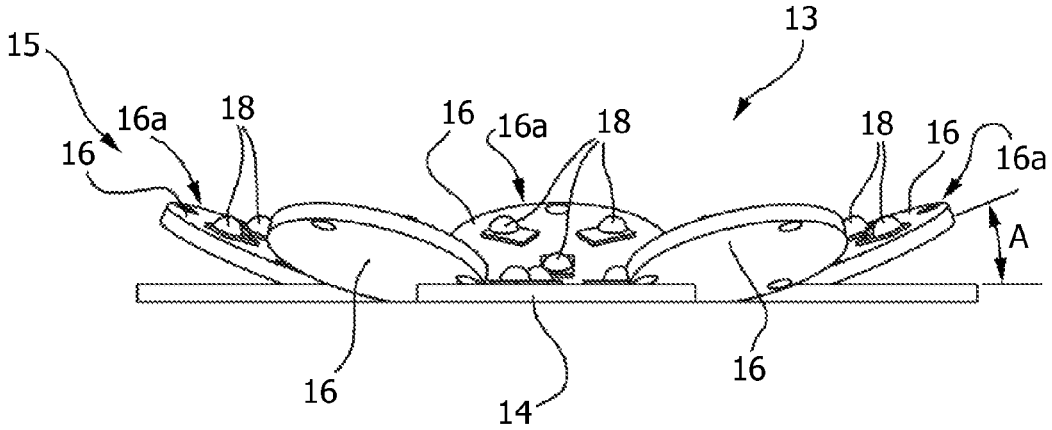
Figure 7:
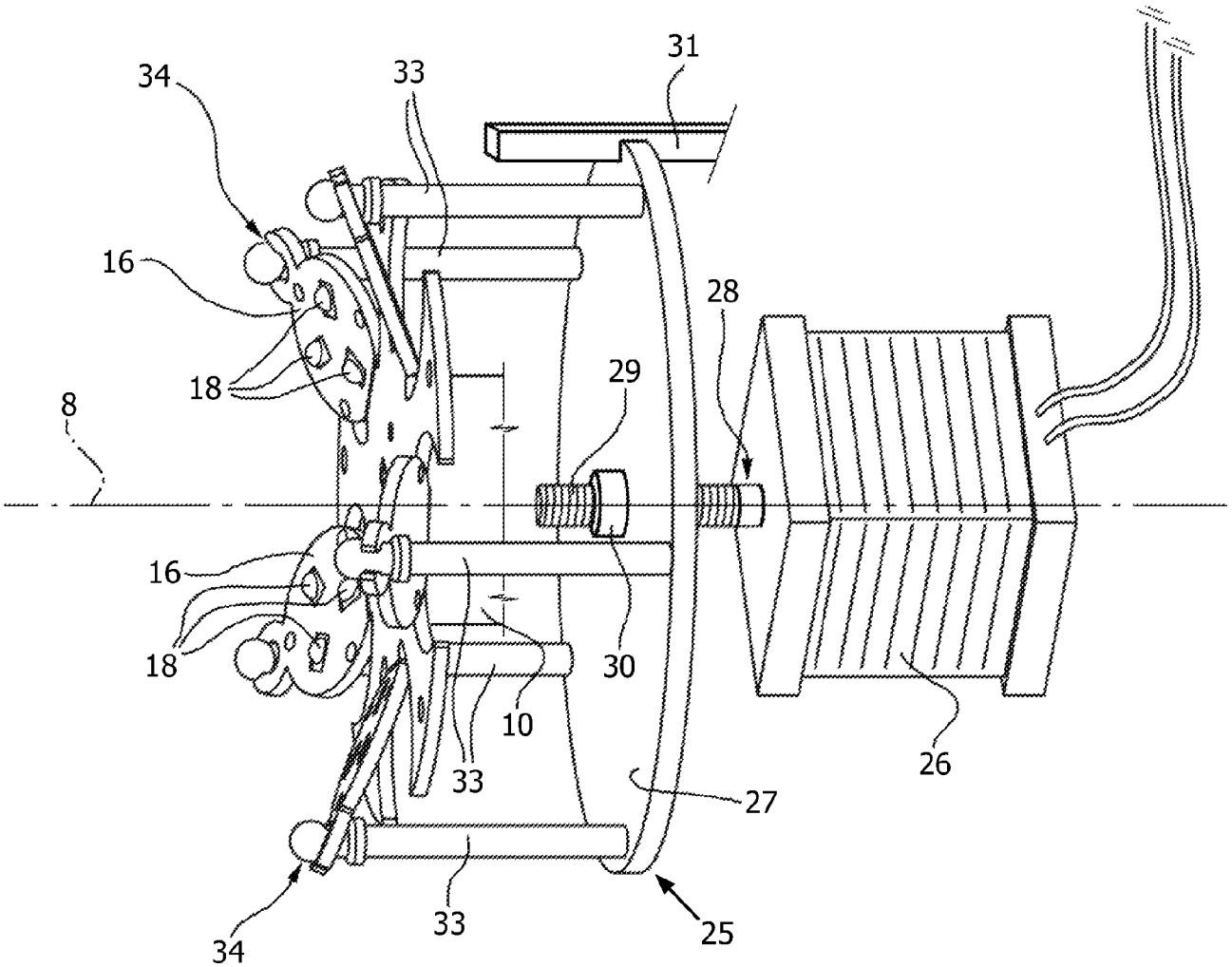
Figure 8:
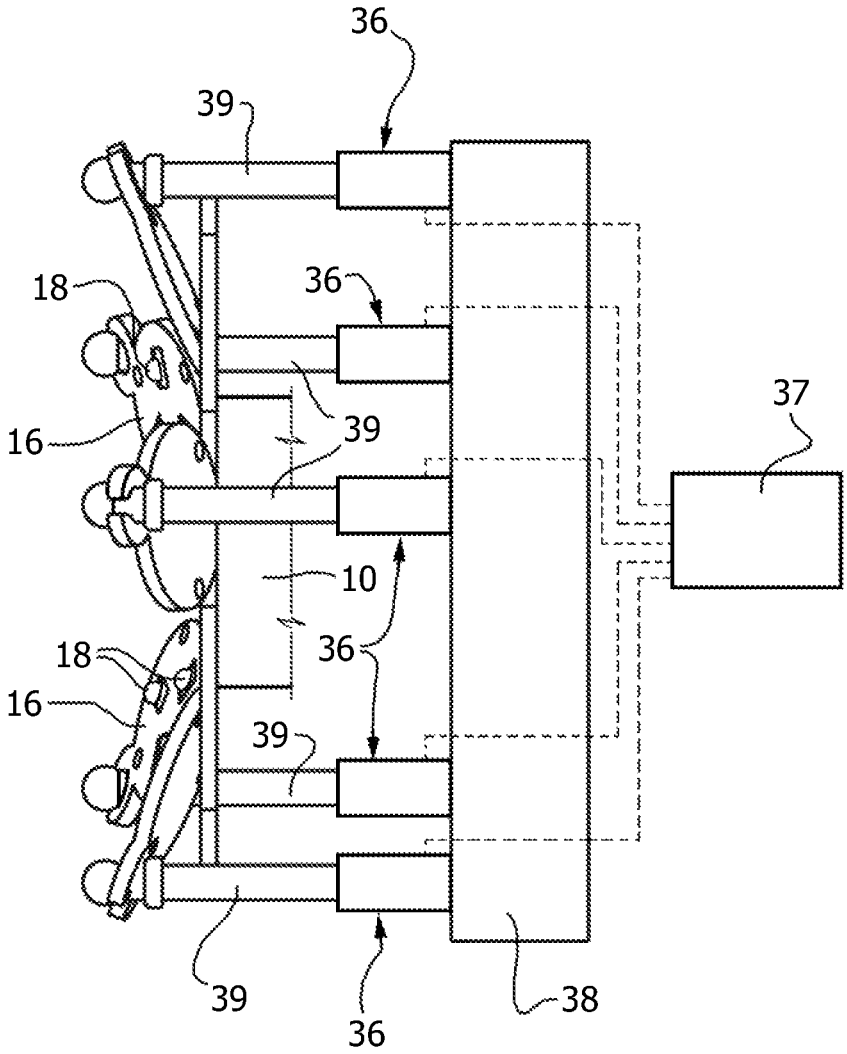

FIGS. 5 and 6 are figures analogous to FIGS. 3 and 4 and they illustrate the detail of FIGS. 3 and 4 in an operating deformed condition;

FIG. 7 is a schematic perspective view with removed portions for clarity of a first variant of the emitting group of FIG. 1; and FIG. 8 illustrates, in side view, a second variant of the emitting group of FIG. 1.

DETAILED DESCRIPTION OF EMBODIMENTS

Figure 2:
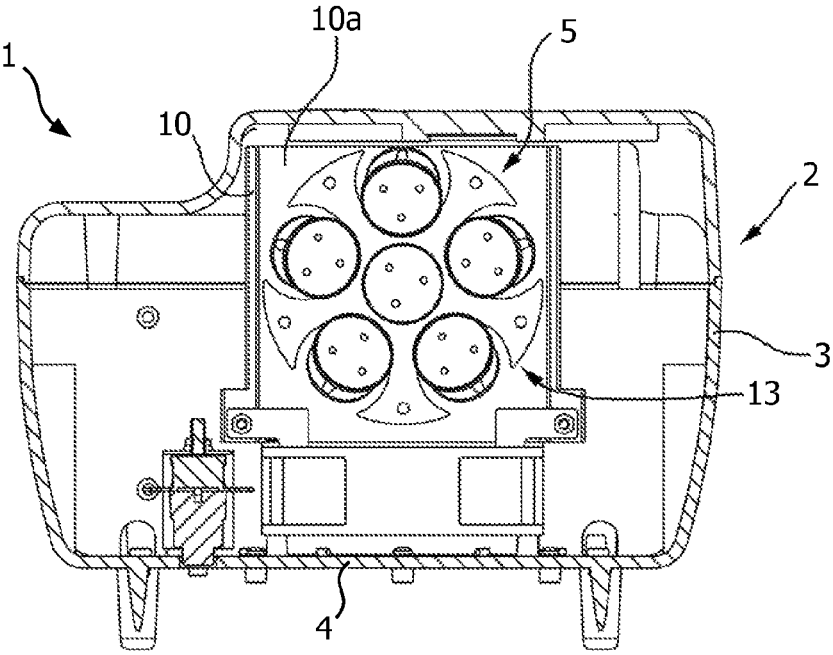
FIG. 2 illustrates, in section, the emitting group of FIG. 1.

In FIGS. 1 and 2, a LED light emitting group is designated as a whole by reference number 1, comprising an outer casing 2, which has a side wall 3 and a bottom wall 4 and it houses a light source 5 and is apt to emit, through an opening 6 of the side wall 3, an outgoing light beam having its own optical axis 8.

The light source 5 comprises a coupling wall 10 which, in the described particular example, extends upwards from the bottom wall 4 of the casing 2 in position faced to the opening 6 and orthogonal to the optical axis 8 and it is equipped on the rear side with a finned heat sink, designated with reference number 11.

Still with reference to FIGS. 1 and 2, the light source 5 further comprises a multiflap body 13, which is implemented as a single piece starting from a plane disk made of metallic material (FIGS. 3 and 4) and it is fixedly connected to a surface 10*a* of the coupling wall 10 faced to the opening 6. According to what illustrated in FIGS. 3 to 6, the multiflap body 13 comprises a central plane portion 14 orthogonal to the optical axis 8 and faced to the opening 6 (FIG. 1) and a crown 15 of peripheral plane portions 16. Each one of the mentioned plane portions 14, 16 carries, fixedly connected to a surface thereof faced towards the opening 6, a respective group 14*a*, 16*a*, of LEDs 18, in the described example in number of three arranged in positions angularly equi-spaced therebetween and, for each LED 18, a related lens 14*a*, 16*b*, known on itself and carried, too, by the related peripheral plane portion 16.

The peripheral plane portions 16 are tilted with respect to the central plane portion 14 and they converge the one towards the other one and towards the central plane portion 14 and the optical axis 8. With specific reference to FIG. 6, each one of the peripheral plane portions with the lying plane of the central plane portion 14 forms a related angle A which, in the particular described example, can vary between twenty and thirty degrees, preferably twenty three degrees. The angular position of each one of the peripheral plate portions 16 with respect to the central plate portion 14 can be set manually by deforming plastically the related portion 20 made of metallic material connecting each one of the peripheral plane portions 16 to the central plane portion 14. In fact, as the disk is shaped like a plate when arranged in a not deformed configuration thereof (illustrated in FIGS. 3 and 4), the angular position of the peripheral plate portions 16 can be chosen arbitrarily so as to obtain an outgoing optical beam having the wished optical features.

Still by referring to FIG. 1, the multiflap body 13 further comprises, between each one of the peripheral plane portions 16, a related coupling appendix 22 coplanar to the central plane portion 14 and fixedly connected to the central plane wall 14 itself.

Preferably, the plane portions 14, 16 and the coupling portions 20 are obtained by cutting, for example by means of laser technology or by means of shearing, the plane disk.

In the variant illustrated in FIG. 7, the angular position of the peripheral plane portions 16 with respect to the central plane portion 14 is adjusted in a continuous or discrete way by means of an adjusting device 25. The device 25 is apt to rotate each one of the peripheral plate portions 16 with respect to the central plate portion 14 which, instead, remains always in fixed position with respect to the axis 8, around a respective hinge axis K (FIGS. 5 and 7), which in the particular described example lies on a lying plane of the central plate portion 14 orthogonally to the optical axis. To this purpose, the device 25 comprises an actuator 26 common to all the peripheral plane portions 16 and an intermediate small plate 27 common, too, to the peripheral plane portions 16 themselves. In the particular described example, the actuator 26 is constituted by an electric motor, an outlet shaft 28 thereof ends with a screw 29 engaging a screw nut 30 carried by the small plate 27. The small plate 27 is coupled to the casing 2, through a guide 31, in a sliding manner in a direction parallel to the axis of the outlet shaft 28 and to the optical axis 8 and in an angularly fixed position and it is coupled to each one of the peripheral plate portions 16 by means of a related tie rod/strut connected to the small plate 27 and coupled to the related peripheral plane portion 16 through a respective joint 34 with related mobility, known on itself and not described in detail.

In the variant illustrated in FIG. 8, the common actuator 26 is replaced by a plurality of actuators 36, each one thereof is dedicated to the motion of the related peripheral plane portion 16 around the related hinge axis K, and it is controlled in an independent way with respect to the other actuators 36 by a command and control unit, designated with 37. The actuators are supported by a common fixed wall 38 integral to the casing 2 and they have respective translating outlet members 39 coupled to the respective peripheral plane portions 16 in the same way of the tie rods/struts 33.

Experimentally one could note that the particular arrangement of the different groups 14*a*, 16*a* of LEDs 18 and, in particular, the fact of providing a first group of LEDs in fixed position along the optical axis 8 of the outgoing beam and a plurality of second groups of LEDs arranged like a crown of the first group of LEDs coaxially to the mentioned optical axis 8 and oriented towards the optical axis 8 itself allows, with respect to the known solutions, obtaining light beams having a high light intensity, on one side, and a lighting uniformity, on the other side.

The use of a common disk cut and bent for supporting the groups of LEDs makes then the described group 1 particularly simple to be implemented and to be assembled but, above all, extremely versatile. In fact, the possibility of adjusting the angular position of the peripheral plane portions 16 with respect to the central plane portion 14 and with respect to the optical axis 8, by simply deforming plastically the related connecting portion 20, allows varying in a not conditioned way the position of the converging point of the light beams emitted by the LEDs along the optical axis 8 itself and then the features of the beam emitted both from a geometrical and a lighting point of view. Such variation allows then, starting from the same particular constituents, obtaining emitting groups having lighting features very different therebetween.

The possibility and easiness in modifying the lighting features of the emitting group 1 are then even more increased in the solutions illustrated in FIGS. 7 and 8, wherein it is possible varying the tilting of the peripheral plane portions by acting from the outside of the group, that is without the need of dismantling one or more components of the emitting group. In case of the group of FIG. 8 it is then possible to vary the position of each one of the peripheral plane portions 16 independently from the other peripheral plane portions 16 and, then, to vary the lighting from area to area.

From what precedes it is clear that to the described group 1 modifications and variants can be introduced, without leaving for this reason the protective scope defined by the claims. In particular, the geometry of the multiflap body 13 and the fastening mode thereof inside the outer casing 2 could be different. Furthermore, both the number of the plane portions 14, 16 and the number of LEDs 18 carried by the single plane portions 14, 16 could be different. At last, the peripheral plane portions 16 could be connected to the central plane portion 14 by means of a hinge device interposed between each one of the peripheral plane portions 16 and the central plane portion 14 and implemented with a material equal or different from the one of the plane portions 14, 16 themselves.

From what precedes it is clear that the described emitting group 1 can be used for different applications and, in particular, as lighter for optical fibre plants and, in this case, an ending portion of the optical fibre cable is inserted into the opening 6, functioning as a lamp or projector. In fact, the particular implementing features of the group make it easy to implement cylindrical beams by easing the application even in theatre environments. The control of LEDs or the use of groups of LEDs with colour different from one plane portion 14, 16 to the other one makes it possible to produce coloured beams as well as to control such colouring.

The invention claimed is:

1. Light emitting diode (LED) light emitting group comprising:

a plurality of LEDs configured to produce an outgoing light beam having an optical axis;

a supporting element that supports said LEDs, wherein said supporting element comprises a coupling base, and a first plate-shaped body carried by said coupling base and comprising a central plane portion orthogonal to said optical axis and a crown of peripheral plane portions tilted with respect to said central plane portion, wherein each of said peripheral plane portions converge toward at least one other peripheral plane portion of the crown, toward the central plane portion and toward said optical axis, wherein the central plane portion and each one of said peripheral plane portions carries a respective subset of the plurality of LEDs and wherein a respective hinge portion is interposed between said central plane portion and each one of said peripheral plane portions; and an actuator machine affixed to said first plate-shaped body and including a second plate-shaped body, wherein said second plate-shaped body is affixed to translating members at bases of the translating members, wherein each of the translating members is in contact with a different one of the peripheral plane portions at a respective contact area, and wherein said machine is configured to translate said second plate-shaped body such that said translating members move linearly and simultaneously at the respective contact areas and are constrained to rotate the respective peripheral plane portions around a respective hinge axis toward or away from said central plane portion such that a converging point of LED light beams from the peripheral plane portions varies along said optical axis.

2. The group according to claim 1, wherein said first plate-shaped body is implemented as a single piece.

3. The group according to claim 1, wherein each one of said peripheral plane portions is connected to said central plane portion by means of a plastically deformable portion configured to keep the respective peripheral plane portion in an operating position which is selectable from a plurality of different operating positions, wherein each of said peripheral plane portions is configured to form a plurality of different angles with said central plane portion.

4. The group according to claim 1, wherein said central plane portion is fixed with respect to said optical axis.

5. The group according to claim 1, wherein the central plane portion and each one of said peripheral plane portions carries three LEDs angularly spaced therebetween by about 120°.

6. The group according to claim 1, wherein said first plate-shaped body comprises an appendix between each one of said peripheral plane portions, wherein said appendix connects the plate-shaped body to said coupling base.

7. The group according to claim 1, wherein said central plane portion is fixedly connected to said coupling base.

8. The group according to claim 1, wherein each of said hinge axes is disposed in a plane of said central plane portion that is orthogonal to said optical axis.

9. The group according to claim 1, wherein said actuator machine comprises a single actuator common to all said peripheral plane portions.

10. The group according to claim 1, wherein said first plate-shaped body comprises a metal.

11. The group according to claim 1, wherein each of said peripheral plane portions includes a respective joint element that is integrated into said first plate-shaped body and is configured to mate with another corresponding joint element of said actuator machine to affix the actuator machine to the first plate-shaped body.

12. The group according to claim 1, wherein the respective contact area of at least one of the translating members is at an outer edge of the respective peripheral plane portion.

* * * * *